US008276815B2

(12) United States Patent
Lim

(10) Patent No.: US 8,276,815 B2
(45) Date of Patent: Oct. 2, 2012

(54) HIGH-SPEED AUTOMATIC FIRE NET-BASED FIRE INSTRUCTION CONTROL SYSTEM FOR SHORT-RANGE ANTI-AIRCRAFT GUN

(76) Inventor: Jong Kook Lim, Chuncheon-si (KR)

( * ) Notice: Subject to any disclaimer, the term of this patent is extended or adjusted under 35 U.S.C. 154(b) by 90 days.

(21) Appl. No.: 12/957,504

(22) Filed: Dec. 1, 2010

(65) Prior Publication Data

US 2011/0297743 A1 Dec. 8, 2011

(30) Foreign Application Priority Data

Jun. 8, 2010 (KR) ..... 10-2010-0053799

(51) Int. Cl.
*G06G 7/80* (2006.01)

(52) U.S. Cl. ..... 235/411; 235/404

(58) Field of Classification Search ..... 235/404, 235/411

See application file for complete search history.

(56) References Cited

U.S. PATENT DOCUMENTS

| | | | | |
|---|---|---|---|---|
| 3,883,091 | A * | 5/1975 | Schaefer | 244/3.13 |
| 4,004,729 | A * | 1/1977 | Rawicz et al. | 235/404 |
| 5,036,748 | A * | 8/1991 | Pendry | 89/36.13 |
| 5,347,910 | A * | 9/1994 | Avila et al. | 89/41.22 |
| 2012/0037749 | A1 * | 2/2012 | Lance et al. | 244/3.12 |

FOREIGN PATENT DOCUMENTS

KR 10-2009-0070757 A 7/2009

* cited by examiner

*Primary Examiner* — Daniel Hess
(74) *Attorney, Agent, or Firm* — LRK Patent Law Firm

(57) ABSTRACT

A high-speed automatic fire net-based fire instruction control system for a short-range anti-aircraft gun is provided. More particular, the present invention relates to a system, in which when a short-range anti-aircraft gun gunner calibrates values indicated on equipment and follows instructions without personally viewing a flying object that has infiltrated at low altitude, a tracking and automatic fire net is constructed, and the gunner follows fire instructions, thus allowing gunners to easily cope with targets anywhere regardless of the location, such as an anti-aircraft defensive position or a contact area, as long as the targets appear on a detection radar even in unfavorable weather or at night which forbids the targets from being detected and identified with eyes.

5 Claims, 3 Drawing Sheets

HIGH-SPEED AUTOMATIC FIRE NET-BASED FIRE INSTRUCTION CONTROL SYSTEM FOR SHORT-RANGE ANTI-AIRCRAFT GUN

CROSS-REFERENCE TO RELATED APPLICATION

This application claims the benefit under 35 U.S.C. 119(a) of Korean Patent Application No. 10-2010-0053799, filed on Jun. 8, 2010, the entire disclosure of which is incorporated herein by reference for all purposes.

BACKGROUND OF THE INVENTION

1. Field of the Invention

The present invention relates, in general, to a high-speed automatic fire net-based fire (shooting) instruction control system for a short-range anti-aircraft gun. More particularly, the present invention relates to a system, in which when a short-range anti-aircraft gunner calibrates values indicated on equipment and follows instructions without personally viewing a flying object that has infiltrated at low altitude, a tracking and automatic fire net is constructed, and the gunner follows fire instructions, thus allowing gunners to easily cope with targets anywhere regardless of the location, such as an anti-aircraft defensive position or a contact area, as long as the targets appear on a detection radar even in unfavorable weather or at night which forbids the targets from being detected and identified with eyes.

2. Description of the Related Art

To date, there has been the fixed idea that in weapon systems for anti-aircraft guns, when a gunner must locate a target in the initial stage and fire at the target after aiming a gun at the target, in order to cope with various aerial threats, the gunner obtains an opportunity to engage the target and can shoot down the target. Although a weapon system has been developed to some degree thanks to the individual aimed fire, there are limitations with respect to detection and identification, and thus such a weapon system cannot produce satisfactory results. Therefore, there is required a substitute technique that will allow a gunner to incapacitate attacks or shoot down targets without detecting and identifying the targets with the naked eye.

Korean Patent Publication No. 10-2009-0070757 (date of publication: Jul. 1, 2009) discloses an invention entitled "Apparatus for controlling anti-aircraft fire in an air base".

The above patent relates to an apparatus for controlling anti-aircraft fire in an air base, which includes a radar signal transmitter, a radar tracking processor, and a fire information terminal in an apparatus equipped with radar protect the air base. The radar signal transmitter is connected to the radar and configured to receive track information of an external flying object from the radar when the flying object is approaching the air base, convert the track information into an optical signal, and output the optical signal. The radar tracking processor receives the optical signal from the radar signal transmitter, reads the track information of the flying object, sets fire data required to apply anti-aircraft fire to the flying object when the flying object is determined to be an enemy aircraft, and outputs the fire data. The fire information terminal notifies an operator who is operating the base of the fire data transmitted from the radar tracking processor, thus allowing the operator to apply the anti-aircraft fire to the flying object.

Further, the radar tracking processor includes an optical reception unit and a radar tracking data processing unit. The optical reception unit receives the optical signal from the radar signal transmitter, converts the optical signal into an electrical signal, and outputs the electrical signal. The radar tracking data processing unit receives the output signal of the optical reception unit, reads the track information tracked by the radar, sets fire data required to fire at the flying object when the flying object is determined to be an enemy aircraft, and transmits the fire data to the fire information terminal.

Furthermore, the fire information terminal is a component which includes a monitor to display the fire data on the monitor so that the operator can view the fire data, and which is capable of communicating with the radar tracking processor in a wired/wireless manner.

The above patent is advantageous in that it can defend against the fire of the enemy without visually checking the approach of the enemy aircraft by way of the system which identifies the flying object using information captured by the radar, sets fire data required to fire at the flying object if the flying object is determined to be the enemy aircraft, and transmits the fire data to the fire information terminal, and which allows the fire information terminal to display the fire data on the monitor. However, the above patent is problematic in that since it relates to a system for transmitting fire data when the enemy aircraft comes within the fire range of an air base, leading fire is impossible.

Further, the effect achieved by defending against the attack of an enemy aircraft using one anti-aircraft gun is limited in that since a bullet fired from the anti-aircraft gun does not track the enemy aircraft as in the case of a missile, it is impossible to correct errors attributable to errors in the radar and the anti-aircraft gun, wind, air density, etc., thus making it difficult to defend against an aircraft infiltrating at high speed. Further, since the radar does not have a function of distinguishing enemy forces from friendly forces and electronic counter-countermeasures (ECCM) ability, information must be received using other methods when information about the enemy aircraft is desired to be obtained and when there is electronic interference. As a result, the radar is problematic in that it requires additional time, and thus there is a possibility that the time to make a defense will be missed.

Therefore, in order to prepare for the case where the enemy's modern high-speed aircraft infiltrates at low altitude, a system that enables accurate leading fire, as well as the configuration of a fire net that is capable of defending against the enemy to cover various types of error ranges using radar information, is required.

SUMMARY OF THE INVENTION

Accordingly, the present invention has been made keeping in mind the above problems occurring in the prior art, and an object of the present invention is to provide a high-speed automatic fire net-based fire instruction control system for a short-range anti-aircraft gun, which can perform accurate leading fire at a flying object that infiltrates at low altitude.

Another object of the present invention is to provide a high-speed automatic fire net-based fire instruction control system for a short-range anti-aircraft gun, which can accurately defend against the pop-up tactics of a flying object that infiltrates at low altitude.

In order to accomplish the above objects, the present invention provides a high-speed automatic fire net-based fire instruction control system for a short-range anti-aircraft gun, the control system including radar having low-altitude detection ability, a digital data processor for generating digital track data based on signals received from the radar, and a modem for transmitting the data generated by the digital data processor, the system including a high-speed automatic fire net-based fire instruction control console device including a calculation unit for calculating an azimuth angle, a distance and an elevation angle of a target, a setting unit for setting data about a fire instruction point, a setting unit for setting data about a defensive fire instruction against pop-up tactics, a data input unit for inputting data, and a display unit for displaying an interface screen; a hand console device for tracking the target and issuing a fire instruction in conjunction with or independently of the high-speed automatic fire net-based fire instruction control console device; and a sound output device for outputting fire instruction sound.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, embodiments of the present invention will be described in detail with reference to the attached drawings.

Figure 1:
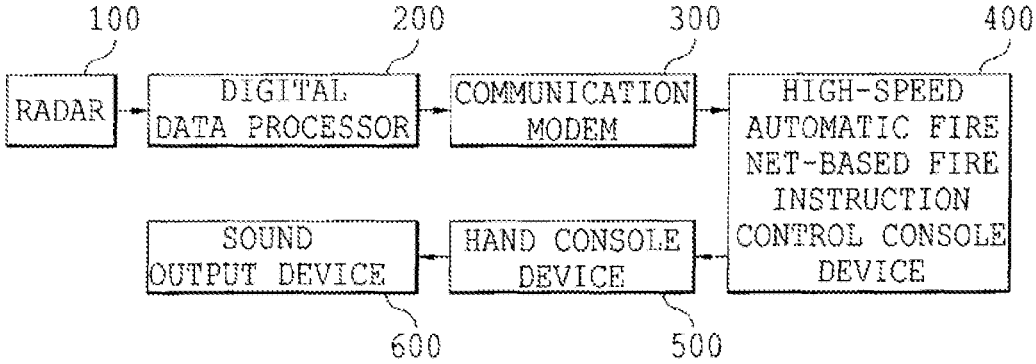
FIG. 1 is a diagram showing the schematic construction of a high-speed automatic fire net-based fire instruction control system for a short-range anti-aircraft gun according to an embodiment of the present invention.

FIG. 1 is a diagram showing the schematic construction of a high-speed automatic fire net-based fire instruction control system for a short-range anti-aircraft gun according to an embodiment of the present invention. As shown in FIG. 1, the high-speed automatic fire net-based fire instruction control system for a short-range anti-aircraft gun according to the present invention includes at least one radar 100 having a low altitude detection ability and having an ability to follow at least one track (tracking ability), a digital data processor 200 for generating digital track data based on signals received from the radar 100, and a modem 300 for transmitting the data generated by the digital data processor 200. The system includes a high-speed automatic fire net-based fire instruction control console device 400, a hand console device 500, and a sound output device 600. The high-speed automatic fire net-based fire instruction control console device 400 includes a calculation unit for calculating the azimuth angle, the distance and the elevation angle of a target, a setting unit for setting data about a fire instruction point, a setting unit for setting data about a defensive fire instruction against pop-up tactics, a data input unit for inputting data, and a display unit for displaying an interface screen.

The hand console device 500 tracks the target and issues a fire instruction in conjunction with or independently of the high-speed automatic fire net-based fire instruction control console device 400.

The sound output device 600 outputs fire instruction sound.

Preferably, the radar 100 must have an excellent low altitude detection function, ECCM ability, and the ability to distinguish enemy forces from friendly forces, and must have tracking ability to follow each track.

The high-speed automatic fire net-based fire instruction control console device 400 may further include a data input device for inputting data.

The high-speed automatic fire net-based fire instruction control console device 400, which is a device for tracking the target, configuring the automatic fire net, and instructing and controlling firing, displays the data about the target captured by the radar 100 on the interface screen in real time.

Figure 2:
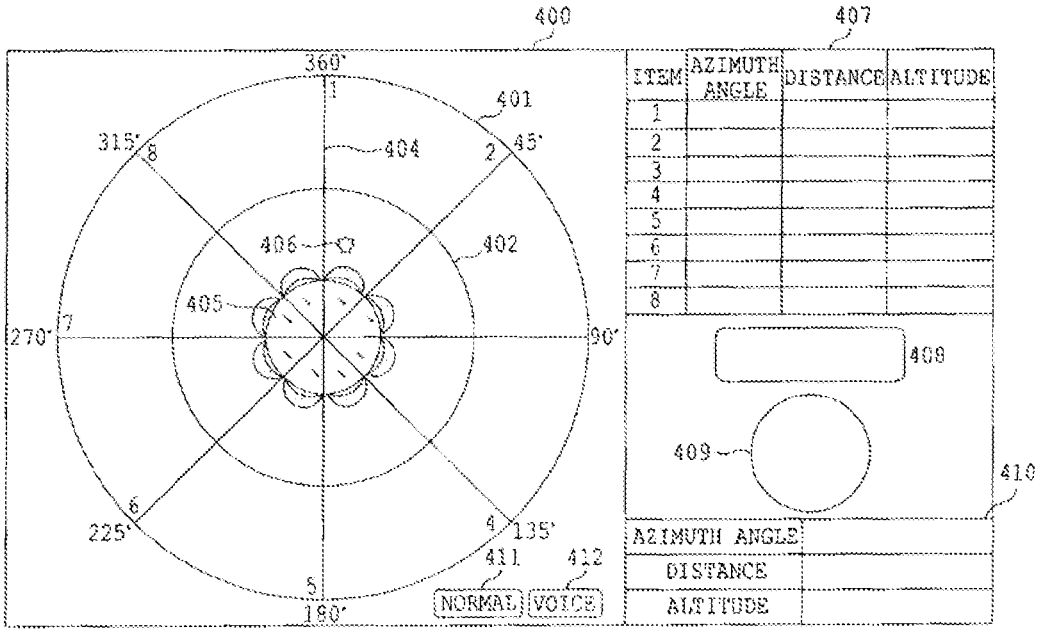
FIG. 2 is a diagram showing the schematic construction of the interface screen of a high-speed fire net-based fire instruction control console device which is a principal component of the present invention.

FIG. 2 is a diagram showing the schematic construction of an embodiment of the interface screen displayed on the display unit of the high-speed automatic fire net-based fire instruction control console device 400.

As shown in FIG. 2, the interface screen of the high-speed automatic fire net-based fire instruction control console device 400 according to the present invention includes a weapon control line 401, 8-directional dividing lines 404, a fire instruction leading point display region 402, a shade display part 403, an entire artillery position display part 405, a target display part 406, a total target display part 407, a first target display part 410, a fire indication lamp 408, a warning sound output part 409, a first switch 411, and a second switch 412. The weapon control line 401 is formed at a distance of 5 nautical miles (NM) from the center point of a defensive position (a military camp site) required to ensure adequate fire preparation time in consideration of the infiltration speed of a high-speed aircraft. The 8-direction dividing lines 404 are lines for dividing eight directions, which are formed using magnetic north as a cardinal point and are configured to pass through the center point of the defensive position at intervals of 45° so that effective fire can be controlled within a fire net. The fire instruction leading point display region 402 displays a fire instruction leading point (Jm) on the basis of the position in which outer guns are arranged when the type of enemy aircraft is input using the data input device (for example, a keyboard) so as to defend against the enemy aircraft which is attacking using pop-up tactics. The shade display part 403 displays a region of the leading point and a predicted attack approach region. The entire artillery position display part 405 inputs the azimuth angle, the actual distance and the altitude of each artillery position from the center point, and displays those values on the screen. The target display part 406 displays targets based on radar information including traces. The total target display part 407 is configured to display all targets ranging from the closest target having the highest priority. The first target display part 410 displays the azimuth angle, the distance and the altitude of the target to be currently engaged. The fire indication lamp 408 and the warning sound output part 409 indicate a warning light and output warning sound, respectively, when the target reaches the leading point at which initial engagement is to be made in each artillery position. The first switch 411 is configured to indicate the normal operation of the high-speed automatic fire net-based fire instruction control console device 400 or switch the device 400 from a standby to normal state. The second switch 412 is configured to switch the high-speed automatic fire net-based fire instruction control console device 400 to voice instruction control mode when the device 400 cannot be operated normally.

The first target display part 410 may be configured such that a manager capable of changing engagement priorities can change the target displayed on the first target display part 410.

When the first switch 411 indicates 'normal operation', the instruction is controlled according to the calculated procedure. The second switch 412 is a switch for performing switching to the voice instruction control mode in an emergency in which the hand console device 500 according to the present invention cannot be used. When the azimuth angles and the elevation angles of the respective artillery positions in eight directions are previously set on the basis of the center point of the defensive position, and voice instruction control information is transmitted to the artillery positions over a communication network in an emergency in which the hand console device 500 cannot be used, the respective artillery positions are provided with data in which the azimuth angles and the elevation angles in the eight directions have been set, and then military operations can be carried out in compliance with the voice instruction control information.

Using the data input device of the high-speed automatic fire net-based fire instruction control console device 400, the azimuth angle, the distance (meter or coordinates), and the earth surface altitude of each artillery position from the location of the radar or from the center point of the defensive position can be input. Further, more preferably, the high-speed automatic fire net-based fire instruction control console device 400 is equipped with a Global Positioning System (GPS), so that when a GPS switch is pressed, related data may be immediately input.

Furthermore, the time of flight (s/sec) and the distance to the maximum fire range or the self-destruction range of a bullet may be input using the data input device, and an action delay time may also be input.

The high-speed automatic fire net-based fire instruction control console device 400 may be configured such that when the type of enemy aircraft is input using the data input device to defend against a target that is attacking using pop-up tactics, a fire instruction leading point required to defend against the pop-up tactics is automatically displayed together with the output of fire warning sound and warning light, and a predicted attack approach region is displayed to be processed as a shaded region.

Furthermore, the high-speed automatic fire net-based fire instruction control console device 400 may be configured to assign holding guns to defend against the enemy aircraft which is making attacks with a short time difference and from different directions, thus enabling defensive control to be simultaneously performed using the holding guns. For example, when there is a need to assign a group of four or more guns, "group" is input. Further, when the number of the enemy aircraft and the number of a relevant artillery position are input, the terminal located in the relevant artillery position may primarily engage the enemy aircraft assigned thereto.

Furthermore, the high-speed automatic fire net-based fire instruction control console device 400 may be configured such that the units of the azimuth angle and the elevation angle may be changed between degree and mil.

Figure 3:
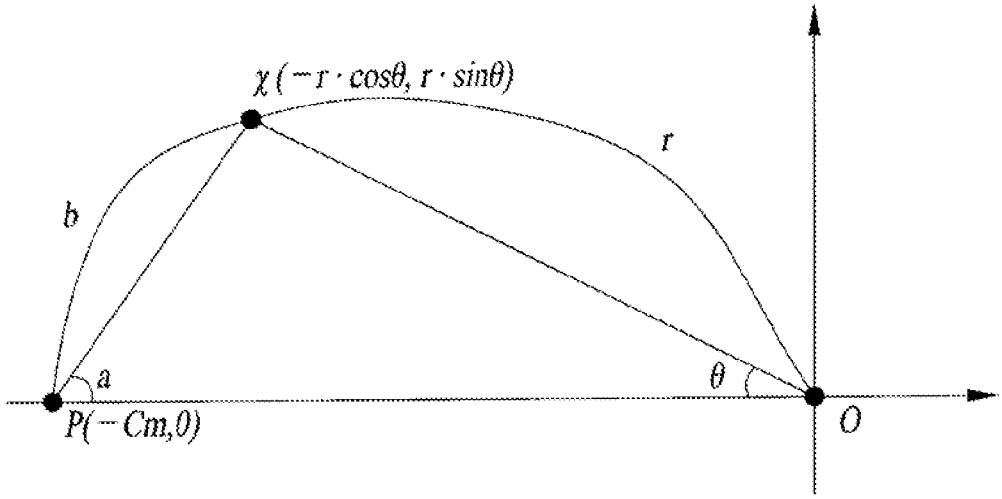
FIG. 3 is a diagram showing a procedure for calculating the azimuth angle, distance and elevation angle of a target in the high-speed automatic fire net-based fire instruction control system for a short-range anti-aircraft gun according to the present invention.

Hereinafter, a process of calculating the azimuth angle, the distance and the elevation angle of the target in the high-speed automatic fire net-based fire instruction control console device 400 will be described in detail with reference to FIG. 3.

For example, in FIG. 3, the azimuth angle, the distance and the elevation angle of the target, which appears around a point of "0" on the radar, with respect to the center point of an anti-aircraft gun position are calculated as follows.

If it is assumed that the azimuth angle of a specific target x with respect to the point "0" is θ, and the distance from the point "0" to the target x is r, the location of the target x can be represented by the following Equation:

$$x=(-r\cdot\cos\theta, r\cdot\sin\theta)\ (\text{where } 0°\leqq\theta\leqq 90°)$$

Further, the slope of a line that connects point P to the target x is calculated by the following Equations:

$$\tan a = \frac{r\cdot\sin\theta}{Cm - r\cdot\cos\theta}$$

$$a = \tan^{-1}\left(\frac{r\cdot\sin\theta}{Cm - r\cdot\cos\theta}\right)$$

A distance b is given by the following Equation using the distance between the two points.

$$b = \sqrt{(Cm - r\cdot\cos\theta)^2 + (r\cdot\sin\theta)^2}$$
$$= \sqrt{Cm^2 - 2Cm\cdot r\cdot\cos\theta + r^2}$$

Therefore, when the arbitrary point x is viewed from the point P, the azimuth angle and the distance are given as follows.

$$\text{azimuth angle: } a = \tan^{-1}\left(\frac{r\cdot\sin\theta}{Cm - r\cdot\cos\theta}\right)$$

$$(\text{where } 0° \leq \theta \leq 90°)$$

$$\text{distance: } b = \sqrt{Cm^2 - 2Cm\cdot r\cdot\cos\theta + r^2}$$

How the high-speed automatic fire net-based fire instruction control console device 400 sets data about the fire instruction point (warning light and warning sound) according to the present invention will be described below.

The calculation of movement distance per sec depending on the approach speed of the aircraft can be performed by the following Equation:

$$\frac{\text{approach speed of aircraft}(KTS)\times 1852}{3600} = \text{Am/s}$$

The period from the time point at which a fire instruction is issued to the time point at which a bullet fired from the anti-aircraft gun makes an initial impact on the infiltrating aircraft is calculated by the following Equations:

fire instruction time+computer processing time (0.25 seconds)+fire action delay time=2 seconds Time of flight up to an anti-aircraft gun maximum fire range (Lb) or up to bullet self-destruction range (Tb): s/sec The leading point in each artillery position for the anti-aircraft gun is given by the following Equation:

s/sec distance+$Am$×(2+s/sec time of flight)=$Bm$

The actual distance (Cm) to each artillery position arranged around the center point which is the center of each group, such as a main defensive position or a region-based defensive position, can be set using a computer. That is, the fire instruction point may be led and may appear so that the initial engagement can be started at the maximum distance (Bm) from the anti-aircraft gun closest to the target.

Next, the setting of data about a defensive fire instruction when a target is attacking using pop-up tactics in the high-speed automatic fire net-based fire instruction control console device 400 according to the present invention will be described in detail.

Pop-up tactics are tactics of moving (movement starts about 3 to 5 km ahead of the target position) in order to drop bombs and perform fire after an aircraft has infiltrated into an enemy position and approached the target of attacks at ultra low altitude to be closest to the attack target so that the aircraft is not exposed to a radar network. In general, it is not considered that when the aircraft must ascend to form an angle for bomb dropping and fire, the speed thereof decreases, and that when the aircraft subsequently descends, an increment of the speed appearing for a short period of time is large. In this state, the current speed of the aircraft is calculated based on the information of the radar and such current speed information is provided, and thus the time to do defensive fire may be missed. Accordingly, with respect to the enemy aircraft which is attacking using pop-up tactics, the present invention calculates the average attack speed thereof, so that a fire instruction leading point may appear, and a predicted attack approach region may be displayed as a shaded region.

The setting of data about a fire instruction point for defending against attacks using pop-up tactics according to the present invention is performed as follows. First, the average of the minimum speed (MIN_SPD) and the maximum speed (MAX_SPD) during a period from the apex (peak) altitude of a type of attacking aircraft, among various types of aircraft of inimical countries, to the dropping of bombs is calculated by the following Equation:

$$\left(\frac{\text{MAX_SPD} - \text{MIN_SPD}}{2}\right) + \text{MIN_SPD} = E_{KTS}$$

where MAX_SPD is bomb dropping speed.

The movement distance per sec depending on the average speed is given by $$\frac{E_{KTS} \times 1852}{3600} = \text{Gm/s.}$$

Therefore, the fire instruction leading point is obtained by the following Equation:

$$\text{S/sec distance} + Gm/\text{sec}(2 + \text{S/sec time of flight}) = Jm$$

The fire instruction leading point may be designated such that Jm is input to the high-speed automatic fire net-based fire instruction control console device 400 and the hand console device 500 on the basis of individual guns that are arranged. That is, when the type of enemy aircraft is input using the data input device, the fire instruction leading point for the enemy aircraft which is attacking using pop-up tactics appears, and defensive fire can be controlled. In this case, pieces of data about various types of inimical aircraft are input in advance to the high-speed automatic fire net-based fire instruction control console device 400 and the hand console device 500, so that a region corresponding to the leading point is processed as a shaded region.

Figure 4:
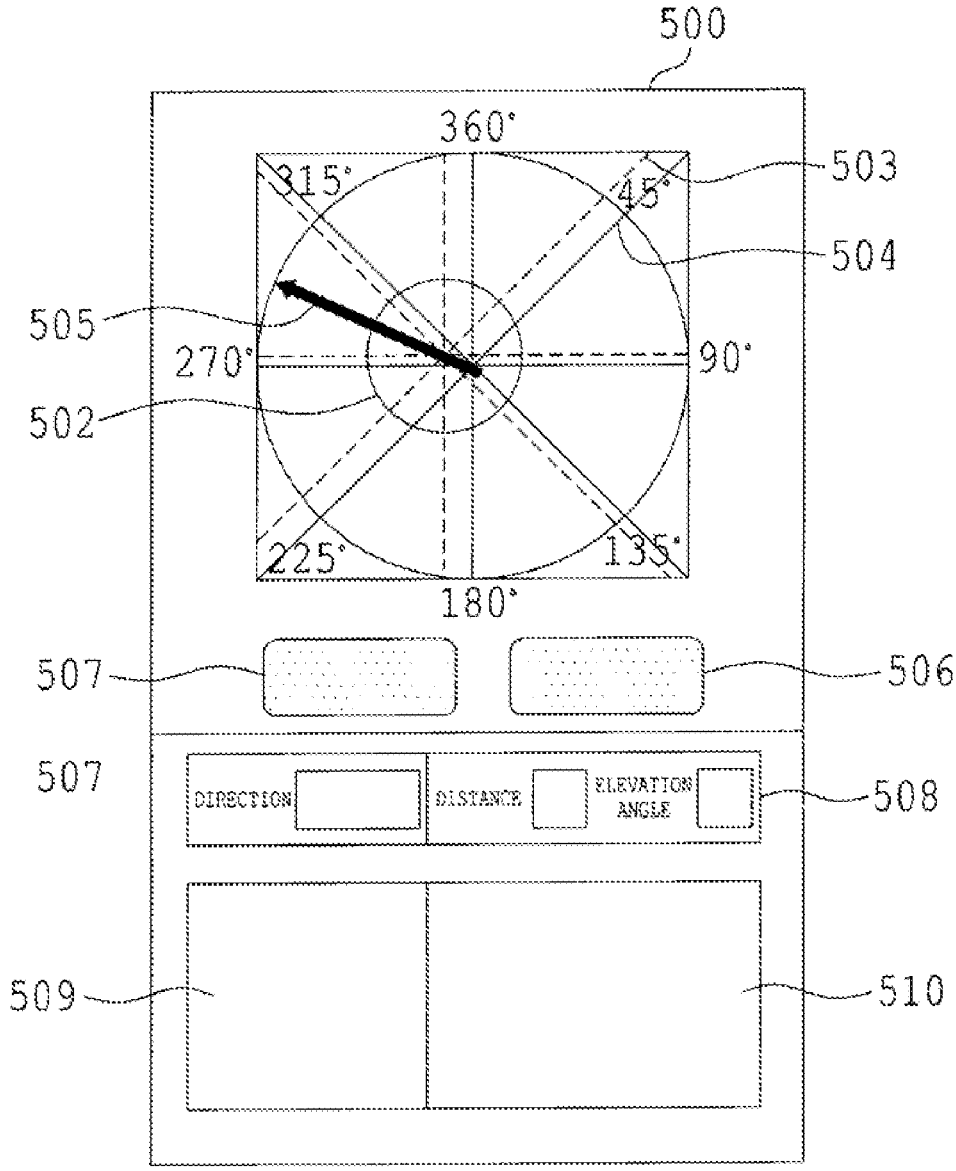
FIG. 4 is a diagram showing the schematic construction of the interface screen of a hand console device which is another principal component of the present invention.

FIG. 4 is a diagram showing the schematic construction of an embodiment of the hand console device 500 which is another principal component of the present invention.

As shown in FIG. 4, the hand console device 500 according to the present invention basically includes a data input device 509 for inputting data such as a surface altitude, and an input display window 510 for displaying the data input using the data input device 509. Further, the hand console device 509 includes defensive position center-based 8-directional dividing lines 503, artillery position center-based 8-directional dividing lines 504, a pop-up tactical defensive fire instruction region 502, a direction indicator 505, a fire warning lamp 506, a warning sound output part 507, and a target display window 508. The defensive position center-based 8-directional dividing lines 503 are automatically displayed as dotted lines by using magnetic north as a cardinal point and are configured to pass through the center point of a defensive position when the azimuth angle, the distance, and the earth surface altitude from an artillery position to the center point of the defensive position are input in the same manner as the high-speed automatic fire net-based fire instruction control console device 400 located in a situation room. The artillery position center-based 8-directional dividing lines 504 are displayed on the screen as solid lines when the center point of the current artillery position is input using the data input device 509. The pop-up tactics-defensive fire instruction region 502 is formed around the center point of the defensive position center-based 8-directional dividing lines 503. The fire warning lamp 506 turns on or off a warning light and the warning sound output part 507 outputs fire warning sound when an enemy aircraft is approaching. The target display window 508 displays the azimuth angle of and the distance (elevation angle) of the target at the current location.

The hand console device 500 may further include, for example, an earphone so that instructions such as a fire instruction can be accurately confirmed in voice.

The data input device 509 is a component for inputting the azimuth angle, the distance, and the earth surface altitude (meter or coordinates) from the radar 100 or the center point of the defensive position to the current location of the gun. The data input device 509 may be configured such that when information about the enemy aircraft is input using the keyboard of the high-speed automatic fire net-based fire instruction control console device, the input information may be transmitted to and stored in the hand console device 500. The hand console device 509 may be configured such that when relevant data is input using the data input device 509, the artillery position center-based 8-directional dividing lines 504 are displayed around the artillery position.

Further, the data input device 509 may preferably be configured to have a GPS button, so that when the GPS button is pressed, location information is input.

The target display window 508 may include a plurality of windows so that after initial engagement has been terminated, pieces of information about engagement targets sequentially appear in the descending order of closeness from a subsequent target closest to the artillery position.

Further, when the information about the enemy aircraft, such as the type of aircraft, is input in advance using the keyboard of the high-speed automatic fire net-based fire instruction control console device in order to issue a defensive fire instruction in the case where the enemy aircraft is attacking using pop-up tactics, the information about the enemy aircraft is transmitted to and stored in the hand console device 500.

The above-described hand console device 500 of the present invention is configured such that the azimuth angle and the distance (elevation angle) of the target from each artillery position appear, a fire instruction leading point (warning light and warning sound) is displayed on the screen, and the enemy aircraft assigned by the high-speed automatic fire net-based fire instruction control console device 400 is automatically displayed on the hand console device 500.

Further, the hand console device 500 may be configured such that when the type of enemy aircraft is input for pop-up tactics or for individual defense against a target which is attacking, a fire instruction leading point and a predicted attack approach region are displayed from the center of the artillery position as shaded portions, and the fire instruction warning light and warning sound are output.

Preferably, the hand console device 500 may be configured to output only information about the enemy aircraft.

The hand console device 500 may be mounted in an anti-aircraft gun and attached to be positioned at eye level, and may preferably be manufactured as a small-sized device so that a user can issue instructions while holding the hand console device in his or her hand. Further, the hand console device 500 may be preferably configured to have an excellent waterproof function so that it can be used even if it snows or rains when military operations are carried out.

Further, the hand console device 500 is configured to change the units of the azimuth angle and the elevation angle between degree and mil.

In the above-described high-speed automatic fire net-based fire instruction control system for a short-range anti-aircraft gun according to the present invention, a low altitude detection radar includes the high-speed automatic fire net-based fire instruction control console device 400, installed in the local situation room of an air base or an anti-aircraft defensive position, in a radar-captured signal transmission system. The radar-captured signal transmission system includes the radar 100 having a function of distinguishing enemy forces from friendly forces, an ECCM ability, and an ability to follow a track (tracking ability), the digital data processor 200, and the communication modem 300. A detection track signal transmitted from the radar-captured signal transmission system is received by the high-speed automatic fire net-based fire instruction control console device 400, so that the received detection track signal is converted in real time into military operation control data required to distinguish enemy forces from friendly forces and to issue fire instructions.

In the high-speed automatic fire net-based fire instruction control console device 400, the azimuth angle and the distance (elevation angle) of the target are displayed. Further, the 8-directional dividing lines 404 are displayed at intervals of 45° using magnetic north as a cardinal point on the screen of the high-speed automatic fire net-based fire instruction control console device 400 so as to conveniently issue fire instructions and control firing in the situation room. Furthermore, a fire instruction point (warning light and warning sound) appears on a leading point depending on the speed of an infiltrating aircraft, and the weapon control line 401 is displayed.

The high-speed automatic fire net-based fire instruction control system for a short-range anti-aircraft gun according to the present invention may preferably be preliminarily operated by receiving information from two or more radars 100.

A user may issue an instruction with the hand console device 500 in hand, and a gunner may conveniently view the hand console device 500 because it is mounted in the anti-aircraft gun.

Further, the communication network is configured such that each artillery position gunner can directly receive a fire instruction or a control instruction from the situation room by using the sound output device 600 such as an earphone, and can take an action in compliance with the instruction, thus minimizing the time required for the propagation of a warning and for the delay time attributable to fire control. Further, each gunner takes an action by accurately receiving an instruction, thus acquiring an opportunity to engage the enemy. Furthermore, the present invention is configured to prepare for ECCM using a wired or wireless network.

The infiltration speeds, bomb drop speeds and distances of high-speed aircraft and low-speed aircraft differ depending on the type of aircraft. Therefore, when the above-described high-speed automatic fire net-based fire instruction control system for a short-range anti-aircraft gun according to the present invention is used, it is operated in conjunction with the radar. When the target reaches a fire instruction point (a leading point) according to the location and speed of the target in the high-speed automatic fire net-based fire instruction control console device 400, if a fire instruction is directly issued to gunners in the situation room, the time required to propagate a warning and the delay time attributable to control can be shortened. Fire is simultaneously performed from an anti-aircraft gun, located at an initial possible engagement distance that is calculated, to all anti-aircraft guns held at the defensive position, thus constituting a fire net. Accordingly, when an aircraft makes an attack, the attack can be capacitated by preventing sight alignment while the aircraft is shot down. Further, even if each anti-aircraft gun deviates from the fire net because of inertia by which it is pushed by rotational radius and centrifugal force, the gun is placed within the fire net and may hit the target. Furthermore, a fire net may be configured to cover errors in radar and an anti-aircraft gun, wind, air density, etc., so that a gunner can defend against attacks without detecting and identifying the enemy with eyes. Furthermore, when the function of calculating an elevation angle depending on the distance of each anti-aircraft gun is added even to a ship which infiltrates the coastline, the coastline can be defended.

Furthermore, according to an embodiment of the present invention, this technology can also be applied to a search ship that is currently being operated.

As described above, the present invention is advantageous in that an accurate fire net (a defensive net in which ramparts are formed using anti-aircraft gun bullets and fragments and in which a target is shot down if the target is hit with the gun bullets, and attacks are capacitated when the fragments are sucked into an engine) can be configured for a high-speed flying object that infiltrates at low altitude, and leading fire can be carried out. Further, the present invention is advantageous in that leading fire can be effectively carried out against the low-altitude pop-up tactics of a flying object. Furthermore, since a low-speed aircraft can be searched for based on a gun barrel, it can be easily identified. Furthermore, defense can be effectively made even at night and bad temporal conditions as long as infiltrating aircraft such as high-speed or low-speed aircraft is captured by radar. Furthermore, when soldiers who monitor a location plate are unnecessary in a situation room, military operations can be carried out using only two or three operators per artillery position, and thus the effect of the reduction of the personnel by several persons can be obtained.

In addition, when an enemy aircraft appears on a radar network, the time required for warning propagation is shortened, and thereby there is no need to perform searching, identification and aiming with the naked eye. Further, after azimuth angles and elevation angles have been adjusted, fire may be performed in compliance with a fire instruction, and thus engagement can be performed before the enemy aircraft drops bombs regardless of it being day or night.

Furthermore, there may be an opportunity to fire a portable surface-to-air missile (SAM) at an enemy aircraft which is conducting evasive maneuvers after detecting the fire net of the present invention.

Furthermore, even when an enemy aircraft approaches while fishtailing, the present invention can defend against the enemy aircraft.

Furthermore, according to the present invention, radars for respective anti-aircraft guns are not required, and a massed defensive net can be constructed at low cost.

Furthermore, the present invention can be applied to all types of anti-aircraft guns that are currently operated, without change.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A high-speed automatic fire net-based fire instruction control system for a short-range anti-aircraft gun, comprising:

at least one radar installed in a base;

a digital data processor for processing signals received from the radar as digital data;

a communication modem for transmitting the digital data received from the digital data processor;

a high-speed automatic fire net-based fire instruction control console device including a calculation unit for calculating an azimuth angle, a distance and an elevation angle of a target, a setting unit for setting data about a fire instruction point, a setting unit for setting data about a defensive fire instruction against pop-up tactics, a data input unit for inputting data, and a display unit for displaying an interface screen; and a hand console device for tacking the target and issuing a fire instruction in conjunction with or independently of the high-speed automatic fire net-based fire instruction control console device, wherein the interface screen of the high-speed automatic fire net-based fire instruction control console device comprises:

a weapon control line formed at a distance of 5 NM from a center point of a defensive position required to ensure a fire preparation time in consideration of an infiltration speed of a high-speed aircraft;

eight-directional dividing lines formed to divide eight directions using magnetic north as a cardinal point and to pass through the center point of the defensive position at intervals of 45° so that efficient fire can be controlled within a fire net;

a shade display part for a fire instruction leading region (Jm), formed based on a position in which outer guns are arranged when a type of enemy aircraft is input using a data input device so as to defend against the enemy aircraft which is attacking using pop-up tactics;

an entire artillery position display part formed to input an azimuth angle, an actual distance and an altitude of each artillery position from the center point of the defensive position, and to display those values on a screen;

a total target display part configured to display all targets ranging from a closest target having a highest priority;

a first target display part configured to display an azimuth angle, a distance and an altitude of a target to be currently engaged;

a fire indication lamp and a warning sound output part configured to indicate warning light and output warning sound when the target reaches a leading point at which initial engagement is to be made in each artillery position;

a first switch configured to indicate a state of normal use of the high-speed automatic fire net-based fire instruction control console device and the hand console device, or used to perform switching to normal operation mode; and a second switch configured to perform switching to voice instruction control mode in an emergency in which the hand console device cannot be operated.

2. A high-speed automatic fire net-based fire instruction control system for a short-range anti-aircraft gun, comprising:

at least one radar installed in a base;

a digital data processor for processing signals received from the radar as digital data;

a communication modem for transmitting the digital data received from the digital data processor;

a high-speed automatic fire net-based fire instruction control console device including a calculation unit for calculating an azimuth angle, a distance and an elevation angle of a target, a setting unit for setting data about a fire instruction point, a setting unit for setting data about a defensive fire instruction against pop-up tactics, a data input unit for inputting data, and a display unit for displaying an interface screen; and a hand console device for tracking the target and issuing a fire instruction in conjunction with or independently of the high-speed automatic fire net-based fire instruction control console device, wherein the hand console device comprises:

a data input device for inputting data such as a surface altitude;

an input display window for displaying data input using the data input device;

defensive position center-based eight-directional dividing lines automatically displayed as dotted lines by using magnetic north as a cardinal point and configured to pass through the center point of the defensive position when an azimuth angle, a distance, and an earth surface altitude from the artillery position to the center point of the defensive position are input in a same manner as the high-speed automatic fire net-based fire instruction control console device located in a situation room;

artillery position center-based eight-directional dividing lines displayed on a screen as solid lines when a center point of a current artillery position is input using the data input device;

a pop-up tactical defensive fire instruction region formed around a center point of the defensive position center-based eight-directional dividing lines; and a target display window configured to display an azimuth angle and a distance (an elevation angle) of the target at a current location.

3. The high-speed automatic fire net-based fire instruction control system according to claim 2, wherein the hand console device further comprises a fire warning lamp for turning on or off a warning light and a sound output part for outputting warning sound activated together with the warning light when the target is approaching.

4. The high-speed automatic fire net-based fire instruction control system according to claim 2, wherein the hand console device is used in conjunction with or independently of the high-speed automatic fire net-based fire instruction control console device.

5. The high-speed automatic fire net-based fire instruction control system according to claim 2, wherein the hand console device further comprises a sound output device for receiving and outputting a fire instruction sound.

* * * * *